US010280743B2

(12) United States Patent
Khan

(10) Patent No.: US 10,280,743 B2
(45) Date of Patent: May 7, 2019

(54) COMMUNICATION SYSTEM FOR AN OFFSHORE DRILLING SYSTEM

(71) Applicant: Halliburton Energy Services, Inc., Houston, TX (US)

(72) Inventor: Jameel A. Khan, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 51 days.

(21) Appl. No.: 15/540,527

(22) PCT Filed: Aug. 9, 2016

(86) PCT No.: PCT/US2016/046192

§ 371 (c)(1),
(2) Date: Jun. 28, 2017

(87) PCT Pub. No.: WO2018/031000

PCT Pub. Date: Feb. 15, 2018

(65) Prior Publication Data

US 2018/0274362 A1 Sep. 27, 2018

(51) Int. Cl.

| | |
|---|---|
| ***E21B 33/08*** | (2006.01) |
| ***E21B 47/14*** | (2006.01) |
| ***E21B 41/00*** | (2006.01) |
| ***E21B 47/12*** | (2012.01) |
| ***E21B 47/06*** | (2012.01) |

(52) U.S. Cl.
CPC ..... *E21B 47/14* (2013.01); *E21B 33/085* (2013.01); *E21B 41/00* (2013.01); *E21B 47/06* (2013.01); *E21B 47/065* (2013.01); *E21B 47/12* (2013.01)

(58) Field of Classification Search
CPC ..... E21B 33/085; E21B 47/14
See application file for complete search history.

(56) References Cited

U.S. PATENT DOCUMENTS

| | | | | |
|---|---|---|---|---|
| 2009/0139724 | A1* | 6/2009 | Gray | E21B 23/04 166/345 |
| 2011/0177779 | A1 | 7/2011 | Rhodes et al. | |
| 2012/0000664 | A1 | 1/2012 | Nas et al. | |
| 2014/0069720 | A1* | 3/2014 | Gray | E21B 33/085 175/5 |

(Continued)

FOREIGN PATENT DOCUMENTS

| | | | |
|---|---|---|---|
| WO | 2006134331 | 12/2006 | |
| WO | 2010006217 | 1/2010 | |
| WO | WO-2014105305 A1 * | 7/2014 | E21B 33/085 |

OTHER PUBLICATIONS

International Search Report and Written Opinion of PCT Application No. PCT/US2016/046192 dated May 1, 2017: pp. 1-19.

*Primary Examiner* — Giovanna C Wright
(74) *Attorney, Agent, or Firm* — Chamberlain Hrdlicka

(57) ABSTRACT

A communication system for an offshore drilling system includes an acoustic transceiver located at a surface location and a rotating control device (RCD) located below sea level. The RCD including a RCD acoustic transceiver configured to transmit data related to the RCD through a packer assembly located inside of the RCD and to the acoustic transceiver located at the surface location. The acoustic transceiver and the RCD acoustic transceiver are configured to wirelessly and bilaterally communicate data between the surface location and the RCD.

20 Claims, 7 Drawing Sheets

(56) References Cited

U.S. PATENT DOCUMENTS

| | | | | |
|---|---|---|---|---|
| 2015/0114658 | A1* | 4/2015 | Donald | E21B 33/035<br>166/344 |
| 2015/0117152 | A1* | 4/2015 | Martin | E21B 47/16<br>367/81 |
| 2015/0308253 | A1* | 10/2015 | Clark | E21B 33/085<br>175/24 |

* cited by examiner

COMMUNICATION SYSTEM FOR AN OFFSHORE DRILLING SYSTEM

This section is intended to provide contextual information to facilitate a better understanding of the various aspects of the described embodiments. Accordingly, it should be understood that these statements are to be read in this light and not as admissions of prior art.

Drilling a wellbore for hydrocarbons requires significant expenditures of manpower and equipment, including maintenance and repair expenditures. For example, rotating equipment requires maintenance as the drilling environment produces forces, elevated temperatures, and abrasive cuttings detrimental to the longevity of seals, bearings, and packing elements, among others. Thus, constant advances are sought to reduce any downtime of equipment and expedite any repairs that become necessary.

In a typical drilling operation, a drill bit is attached to a drill pipe. Thereafter, a drive unit rotates the drill pipe through a drive member, such as a kelly, as the drill pipe and drill bit are urged downward to form the wellbore. In some arrangements, a kelly is not used, thereby allowing the drive unit to attach directly to the drill pipe or tubular. The length of the wellbore is determined by the location of the hydrocarbon formations. In many instances, the formations produce fluid pressure that may be a hazard to the drilling crew and equipment unless properly controlled.

Several components are used to control the fluid pressure. Typically, one or more blowout preventers (BOP) are mounted with the well forming a BOP stack to seal the well. In particular, an annular BOP is used to selectively seal the lower portions of the well from a tubular that allows the discharge of mud. In many instances, a rotating control device (RCD) or rotating control head is mounted above the annular BOP or the BOP stack. An inner portion or member of the RCD is designed to seal and rotate with the drill pipe. The inner portion or member typically includes at least one internal sealing element mounted with a number of bearings in the RCD.

During the drilling operation, the drill pipe or tubular is axially and slidably moved through the RCD. The axial movement of the drill pipe along with other forces experienced in the drilling operation, some of which are discussed below, causes wear and tear on the bearing, the packer, and/or the seal assembly such that the RCD subsequently requires repair. Further, the thrust generated by the wellbore fluid pressure, the radial forces on the components, and other forces, can cause a substantial amount of heat to build within the RCD. The heat causes the bearings, packer, and/or seals to wear and subsequently require repair. Further, the RCD is normally used in the presence of drilling fluid, and in the case of offshore environments, seawater. These fluids are often corrosive with high salinity content, further adding to the need to monitor and properly maintain the RCD and its components.

The components of the RCD include sensors, transmitters, and receivers, among other communication devices, used to capture and transmit data related to the RCD. For example, data related to the status of a latching mechanism associated with the RCD, such as latched or unlatched status, can be transmitted from the RCD to an on-shore facility or control system. In other cases, the communication devices of the RCD may be used to gather and transmit information in an emergency situation.

However, the communication devices often function at a low-duty cycle (i.e., the fraction of time for a signal to complete an on-and-off cycle) in a subsea environment and are often forced into a power-saving mode (i.e., sleeping mode) in an effort to conserve energy and to increase the life of the sensors. There is often a trade-off between energy savings and performance degradation since the communication devices function at lower transmission rates and with decreased sensing capabilities. For instance, the communication devices often provide intermittent sensing performance that hinders sensing capabilities, thus, leading to detection failure. In addition to transmitting the minimum amount of data, any data transmitted from the RCD using typical communication devices may not include real-time data, for example, RCD condition data such as pressure or temperature parameter data. In this regard, the transmission of data between the RCD and components of the on-shore facility or control system is hindered.

BRIEF DESCRIPTION OF THE DRAWINGS

For a detailed description of the embodiments of the invention, reference will now be made to the accompanying drawings in which.

DETAILED DESCRIPTION

Figure 1:
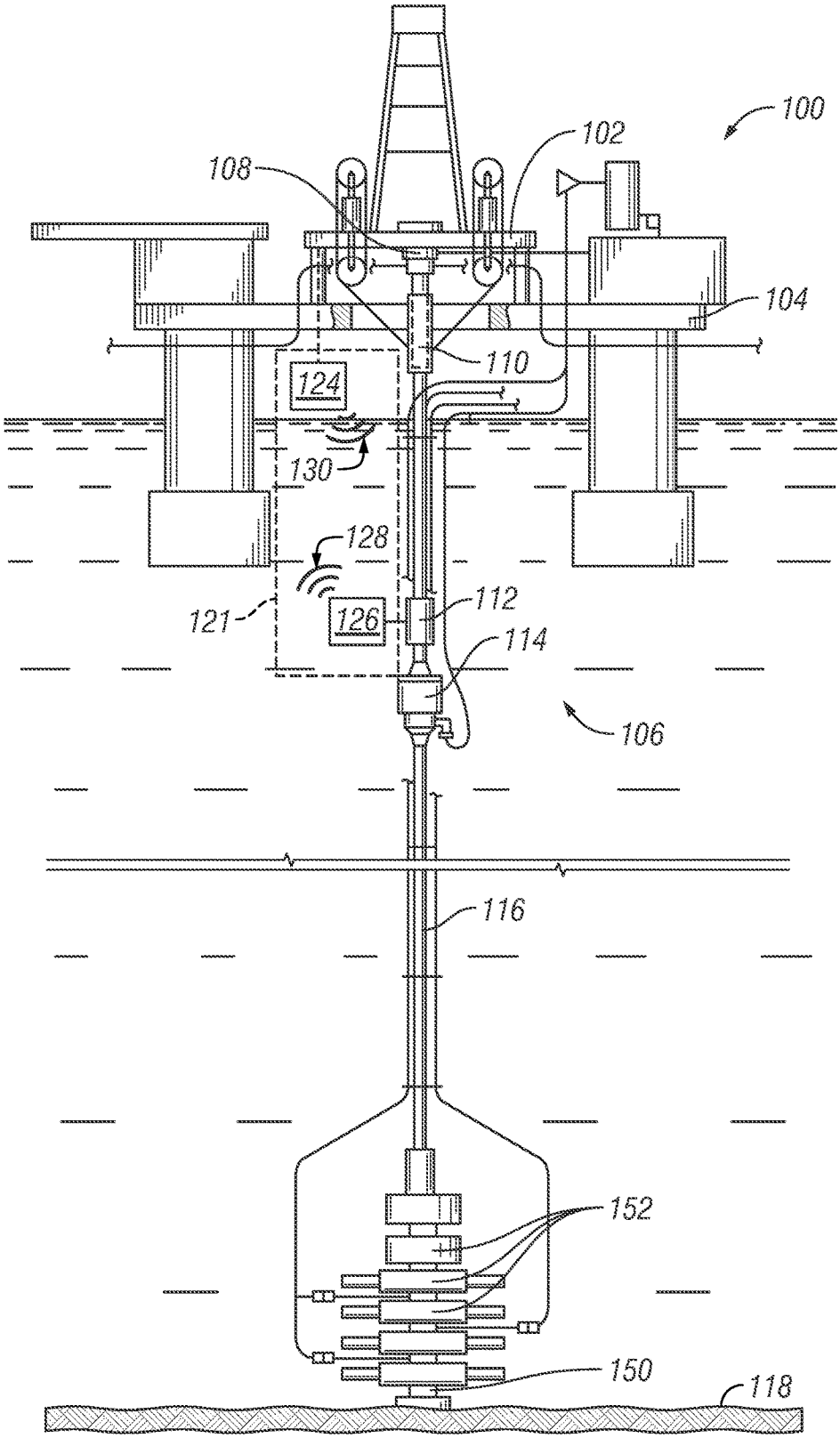
FIG. 1 depicts a schematic view of an example offshore drilling system, according to one or more embodiments.

Referring now to FIG. 1, a schematic view of an offshore drilling system including an offshore drilling platform 100 in accordance with one or more embodiments of the present disclosure is shown. While the offshore drilling platform 100 is depicted as a semi-submersible drilling platform, it should be appreciated that a platform of any type can be used including, but not limited to, drillships, spar platforms, tension leg platforms, and jack-up platforms. The offshore drilling platform 100 includes a rig floor 102 and a lower bay 104. A riser assembly 106 extends from a subsea wellhead 150 to the offshore drilling platform 100 and includes various drilling and pressure control components, such as one or more blowout preventers 152 that are positioned atop the subsea wellhead 150.

From top to bottom, the riser assembly 106 includes a diverter assembly 108, a slip joint 110, a rotating control device (RCD) 112, an annular blowout preventer 114, and a string of riser pipe 116 extending to the subsea wellhead 150. While one configuration of riser assembly 106 is shown and described in FIG. 1, it is understood that various types and configurations of the riser assembly 106 can be used in conjunction with embodiments of the present disclosure. Specifically, it should be understood that a particular configuration of the riser assembly 106 used will depend on various factors including the configuration of the subsea wellhead 150, the type of offshore drilling platform 100 used, and the location of the offshore drilling platform 100.

Because the offshore drilling platform 100 is a semi-submersible platform, it is expected to have significant relative axial movement (i.e., heave) between its structure (e.g., rig floor 102 and/or lower bay 104) and a sea floor 118. Therefore, a heave compensation mechanism is employed so that tension is maintained in the riser assembly 106 without breaking or overstressing sections of the riser pipe 116. As such, the slip joint 110 is constructed to allow relative displacement and compensate for wave action experienced by the offshore drilling platform 100. Furthermore, a hydraulic member (not shown) connects between the rig floor 102 and the riser assembly 106 to provide upward tensile force to the string of the riser pipe 116, as well as to limit a maximum stroke of the slip joint 110. To counteract translational movement (in addition to heave) of the offshore drilling platform 100, an arrangement of mooring lines (not shown) can be used to retain the platform 100 in a substantially constant longitudinal and latitudinal area.

In certain operations including, but not limited to drilling operations, the riser assembly 106 is required to handle high annular pressures. However, components, such as the diverter assembly 108 and the slip joint 110, are typically not constructed to handle the elevated annular fluid pressures associated with drilling. Thus, the components in an upper portion of the riser assembly 106 should be isolated from the elevated annular pressures experienced by components located in a lower portion of the riser assembly 106. Accordingly, the RCD 112 is included in the riser assembly 106 to rotatably seal about a drillstring (not shown). In particular, the RCD 112 is positioned within the riser string 116 to prevent high pressure annular fluids in the riser string 116 from reaching the slip joint 110, the diverter assembly 108, and the environment.

In the embodiments, the RCD 112 isolates pressures in excess of 1,000 psi while the drillstring is rotating (i.e., dynamic) and 2,000 psi when the drillstring is not rotating (i.e., static) from upper portions of the riser assembly 106. While the annular blowout preventer 114 is capable of similarly isolating annular pressures, such annular blowout preventers are not intended to be used when the drillstring is rotating, as would occur during a drilling operation. In other embodiments, additional RCDs and blowout preventers can be added to the offshore drilling platform 100 for redundancy and safety issues, in addition, to monitoring pressures and confining well fluids to a wellbore, among other functions.

In the embodiments, the RCD 112 includes one or more sensors (not shown) to detect and/or measure conditions of the RCD 112 and other equipment in close proximity to the RCD 112. Further, the RCD 112 can include transmitters, receivers, or transceivers, among other communication devices. However, typical communication devices are often not capable of transmitting and/or receiving real-time, i.e., dynamic data, with increased transmission rates and distances in a subsea environment. In particular, the subsea environment includes fluids that hinder data transmission (e.g., saline fluids, drilling mud) and, thus, additional equipment and devices are often used to overcome the hindrances.

In the embodiments, an acoustic telemetry system 121 enables the propagation of real-time data, such as data related to the current conditions of the RCD 112, conditions and equipment in close proximity to the RCD 112, or subsea data that is continuously updated. In the present embodiments, the acoustic telemetry system 121 includes an acoustic transceiver 124 located on the offshore drilling platform 100 and a RCD acoustic transceiver 126 that is electrically connected to the RCD 112. Although depicted as being attached to an external surface of the RCD 112, the RCD acoustic transceiver 126 is located within the RCD 112. The acoustic transceiver 124 and the RCD acoustic transceiver 126 are configured to wirelessly and bi-laterally, i.e., simultaneous two-way direction, transmit data between the offshore drilling platform 100 and the RCD 112. In the embodiments, acoustic signals are used to communicate the data between the RCD 112 and the offshore drilling platform 100 when data is generated and transmitted in a subsea environment.

To transmit data from the RCD acoustic transceiver 126 to the acoustic transceiver 124, sensors (not shown) of the RCD 112 may capture pressure, temperature, vibration, and rotational speed signal data, among other types of signal data. The RCD acoustic transceiver 126 can convert the signal data so as to acoustically transmit data 128 that may relate to conditions of the RCD 112 as they are occurring (i.e., real-time). For example, the RCD acoustic transceiver 126 can transmit pressure data related to a seal assembly of the RCD 112 to warn of pressure leaks. The data 128 once received at the acoustic transceiver 124 is converted to digital data and displayed on any type of device located on the offshore drilling platform 100 or an on-shore location. Similarly, the acoustic transceiver 124 can acoustically transmit data 130 to the RCD acoustic transceiver 126, for example, data related to configuring the RCD 112 or any other components in close proximity to the RCD 112. As will be further discussed, the data 128, 130 is transmitted from and into the RCD 112 through a packer assembly (not shown) without the use of additional electronic components used during data transmission. The packer assembly provides an area of the RCD 112 to transmit and/or receive the acoustic data 128, 130 that does not include seawater, drilling mud, salt cutting, or other salty fluids that often hinder data transmission.

At deeper water depths, i.e., depths greater than 1000 ft (300 m) and that exceed about 5,500 ft (1,700 m), sound waves can travel relatively intact and undisturbed so that transmission loss, if any, is mainly a factor of distance. Conversely, in shallow water depths (0 ft-1,000 ft (0 m-300 m)), the distance between the surface of the water and the sea floor is often limited for sound wave propagation, thus, leading to sound waves scattering, refraction, and reflection issues. In addition, shallow waters include an increased temperature gradient that can hinder data transmission. However, the RCD 112, the acoustic transceiver 124, and the RCD acoustic transceiver 126 of the present embodiments, when located in shallow water, can provide increased bi-laterally and acoustic data transmission, with increased sensing capabilities, regardless of the changes in the acoustic noise floor or the water depth. Additionally, a repeater device can be added to the riser assembly 106 to aid in the mitigation of signal attenuation.

A duty-cycle for data transmission provides for the period of time it takes a signal to complete an on-and-off cycle. Often expressed as a ratio or a percentage, the duty-cycle is measured as a fraction of a second, an hour, a day, or any other unit of time, depending on the total length of time for operations. In the present embodiments, an improved data transmission duty cycle for the transmission of data between the acoustic transceiver 124 and the RCD acoustic transceiver 126 includes an increased number of data transmissions per duty cycle. In particular, the amount of data transmitted during each duty cycle between the acoustic transceiver 124 and the RCD acoustic transceiver 126 provides an increased throughput of data for a longer duration of time. Moreover, the acoustic transceiver 124 and the RCD acoustic transceiver 126 are capable of transmitting data at speeds from about 140 bits per second (bps) up to about 15,400 bps.

The optimal data transmission duty cycle of the acoustic telemetry system 121 provides a duty cycle with a range of about 50% to about a 100%. For instance, a data transmission signal between the acoustic transceiver 124 and the RCD acoustic transceiver 126 can provide a 60% duty cycle where the signal transmits data for 60% of the total time period. This extended period of time can provide for a more robust data transmission. In this case, the RCD acoustic transceiver 126 can transmit data other than the latch/unlatch status data related the RCD 112 to the acoustic transceiver 124 without the use of umbilical cords or any other type of wired connections and additional equipment. In addition to wirelessly and bilaterally transmitting pressure, temperature, vibration, and rotational speed data, other types of data can be transmitted including data related to the loss of circulation, poor stability, stripping rate, rate of penetration (ROP), joint count associated with the tool joints of downhole equipment, and pressure and/or temperature data associated with the seal element of the RCDs. By expanding the data transmission duty-cycle capabilities of the RCD 112, along with wireless and bilateral communication capabilities, any limits on the amount, type, and rate of data transmitted to and from the underwater RCD 112 are substantially reduced or removed.

Figure 2:
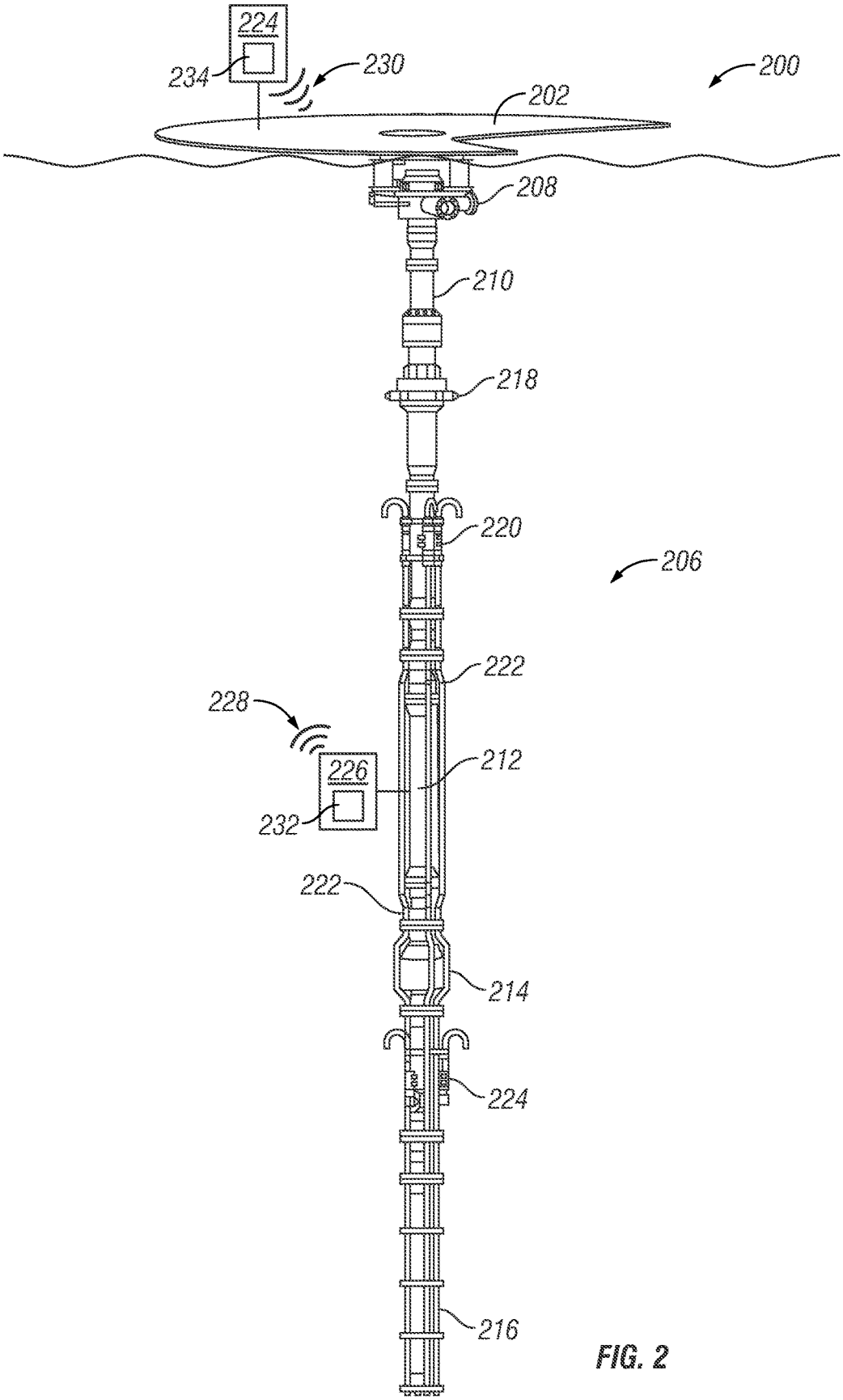
FIG. 2 depicts a perspective view of a portion of an example offshore drilling system, according to one or more embodiments.
Figure 3:
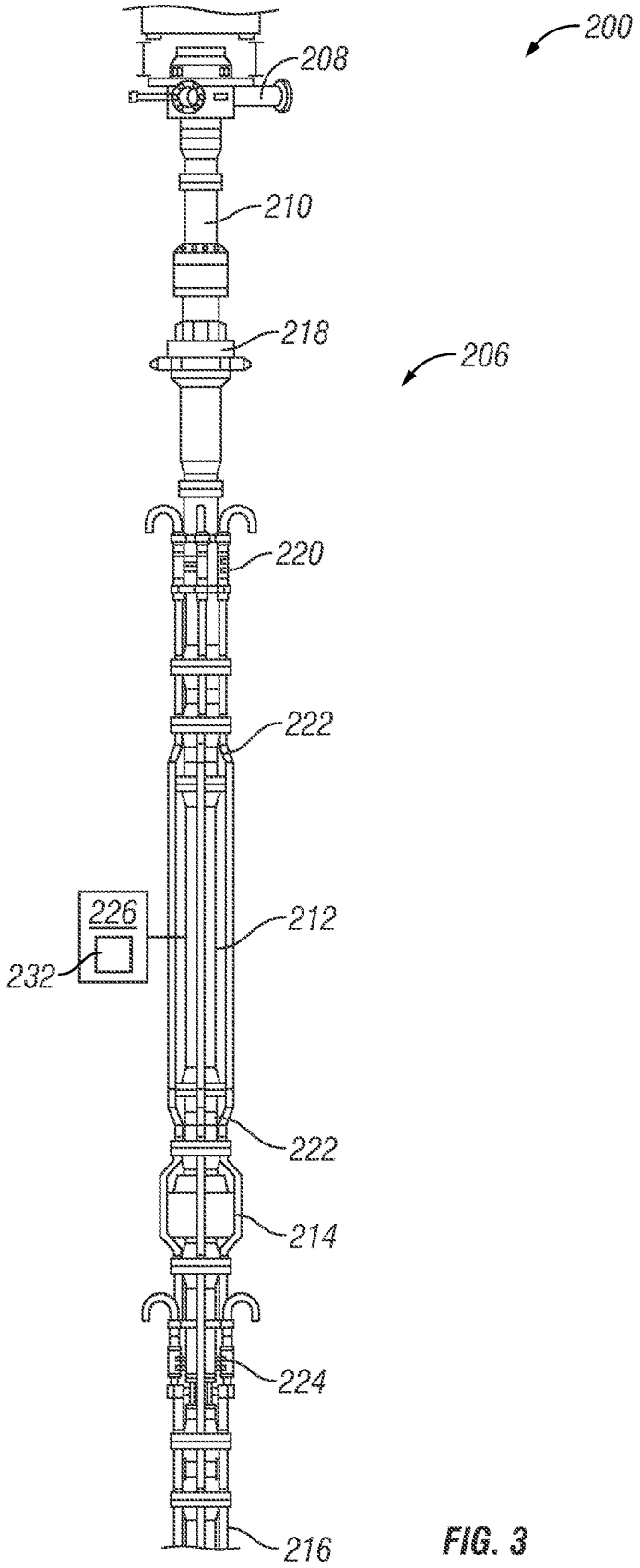
FIG. 3 depicts a perspective view of a portion of an example offshore drilling system, according to one or more embodiments.
Figure 4:
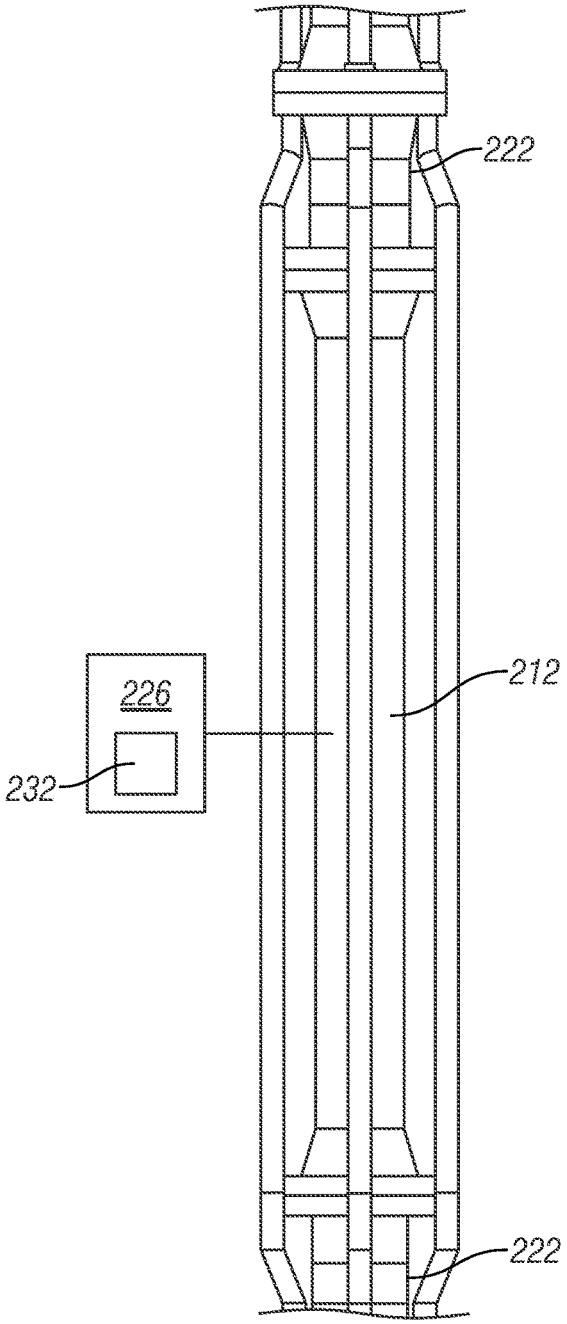
FIG. 4 depicts a perspective view of an example RCD, according to one or more embodiments.

Referring now to FIGS. 2-4, multiple views of portions of an offshore drilling system 200 in accordance with one or more embodiments of the present disclosure is shown. In particular, FIG. 2 shows a perspective view of the offshore drilling system 200 with reference to an offshore drilling platform 202, FIG. 3 shows a more detailed perspective view of the offshore drilling system 200, and FIG. 4 shows a more detailed view of a RCD 212 included within the offshore drilling system 200.

The offshore drilling platform 202 includes a riser assembly 206 that is supported by and extends from the offshore drilling platform 202. In this embodiment, the riser assembly 206 includes a diverter assembly 208, a slip joint 210, a RCD 212, an annular blowout preventer 214, and a drilling riser 216 (e.g., string of riser pipe) extending to a subsea wellhead (not shown). The riser assembly 206 further includes a tension ring 218 and a termination joint 220 positioned between the RCD 212 and the platform 202, crossover joints 222 positioned on one or both sides of the RCD 212, and a RCD flow spool 224 positioned between the drilling riser 216 and the RCD 212 or blowout preventer 214.

An acoustic transceiver 224 is electrically connected to the offshore drilling platform 202 and located at a surface location and a RCD acoustic transceiver 226 is electrically connected to the RCD 212. In the embodiments, one or more RCDs 212 and RCD acoustic transceivers 226 can be located in various areas along the riser assembly 206. Although FIG. 2 depicts the RCD acoustic transceiver 226 as attached to an external surface of the RCD 212, the RCD acoustic transceiver 226 can be electrically attached to an internal surface of the RCD 212. In operation, the acoustic transceiver 224 and the RCD acoustic transceiver 226 provide bilateral, acoustic transmission of data between the acoustic transceiver 224 and the RCD acoustic transceiver 226. As will be further discussed, data is transmitted from and into the RCD 212 through a packer assembly (not shown) without the use of additional electronic components often used during data transmission. The packer assembly provides an area of the RCD 212 to transmit and/or receive the acoustic data 232, 230 that does not include seawater, drilling mud, salt cutting, or other salty fluids that often hinder data transmission.

The RCD acoustic transceiver 226 includes one or more sensors 232 that monitor the conditions of the RCD 212, the conditions located in close proximity to the RCD 210, and conditions of any other drilling components located in close proximity to the RCD 212. In some examples, the sensors 232 can be mounted to an external surface of the RCD 212. The RCD acoustic transceiver 226 receives data from the sensors 232 in the form of a signal and converts the signal into transmittable acoustic data 228. The RCD acoustic transceiver 226 wirelessly transmits the acoustic data 228 to the acoustic transceiver 224. In embodiments, the acoustic data 228 includes pressure, temperature, vibrations, and rotational speed data, among other environmental parameter data related to the RCD 212.

The acoustic transceiver 224 can include sensors 234 that measure data located at the surface location or can receive data from an input device (not shown) located on offshore drilling platform 202 or an onshore locations. For example, the sensors 234 provides surface location data useful to the operations of the RCD 212 and the input device provides the acoustic transceiver 224 with data to transmit to the RCD 212, for example, RCD configuration data. The acoustic transceiver 224 converts and wirelessly transmits the sensor signal and/or input data as acoustic data 230 to the RCD acoustic transceiver 226.

In addition to pressure, temperature, vibration, and rotation speed sensors, the sensors 232, 234 can include strain gauge sensors, reed switches, resistance temperature detectors (RTD), or any other type of suitable sensors. For example, the sensor 232 can include a thermometer to measure the temperature within the RCD 212 or the area external to the RCD 212 and a pressure gauge or transducer to measure the pressure within the RCD 212. The sensor 232 can include an accelerometer to measure the vibrations within or experienced by the RCD 212, a tachometer to measure the rotational speed of the RCD 212, and so forth. Accordingly, real-time data related to the RCD 212 or to be used by the RCD 212 is wirelessly and bilaterally transmitted at improved duty cycles to expand the speed, distance, and type of data transmitted and received.

It is understood that the RCD acoustic transceiver 226 includes an acoustic transceiver capable of water submersion as it applies to the present embodiments. In addition to the sensors 232 and 234, the transceivers 224 and 226 can include various types of positioning components, electrical circuitry, digital platforms, among other components, for control and signal processing. Furthermore, the acoustic data 228 and 230 can include any type of data transmittable in an underwater environment.

Figure 5:
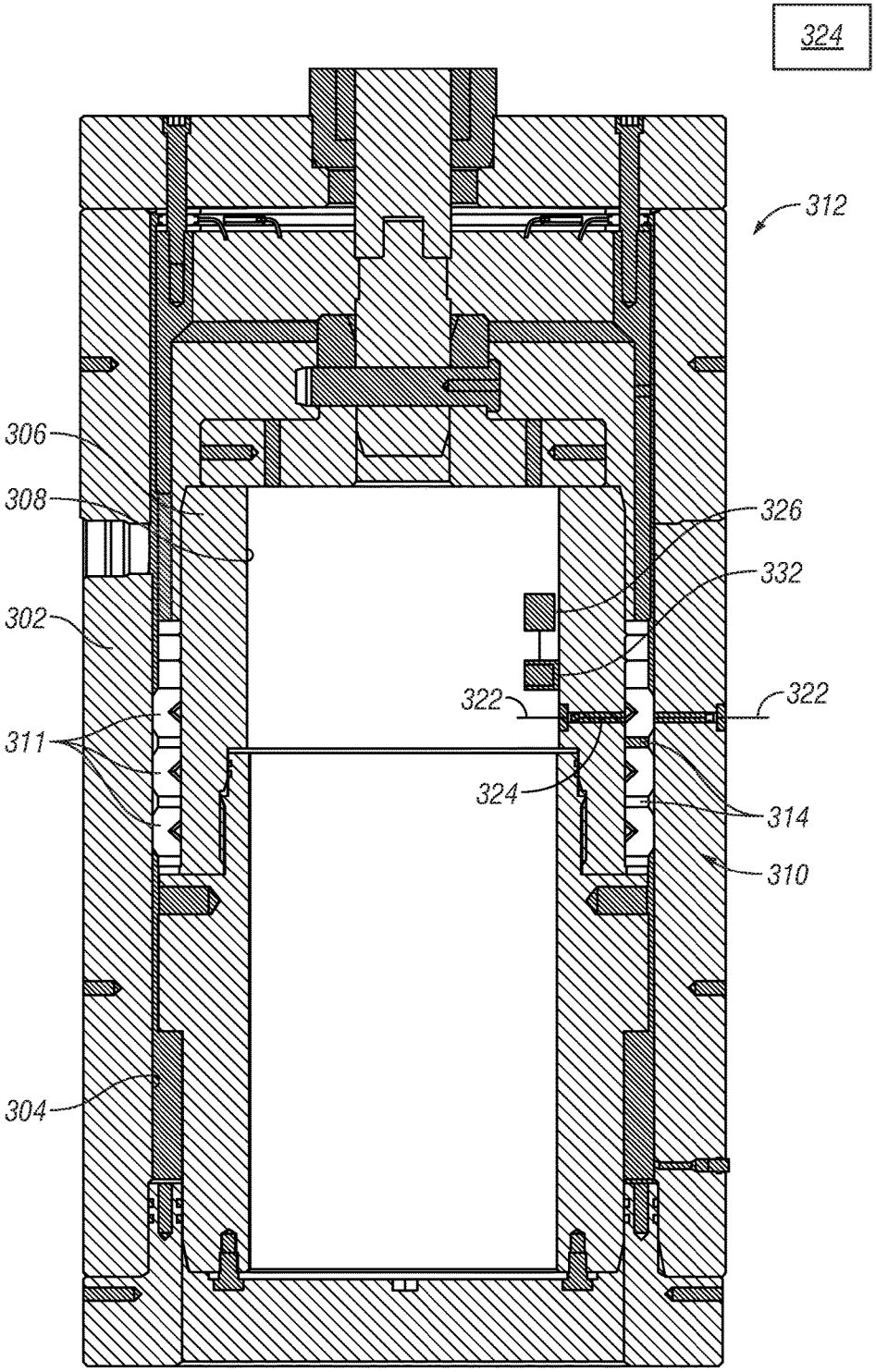
FIG. 5 depicts a cross-sectional view of an example RCD, according to one or more embodiments.
Figure 6:
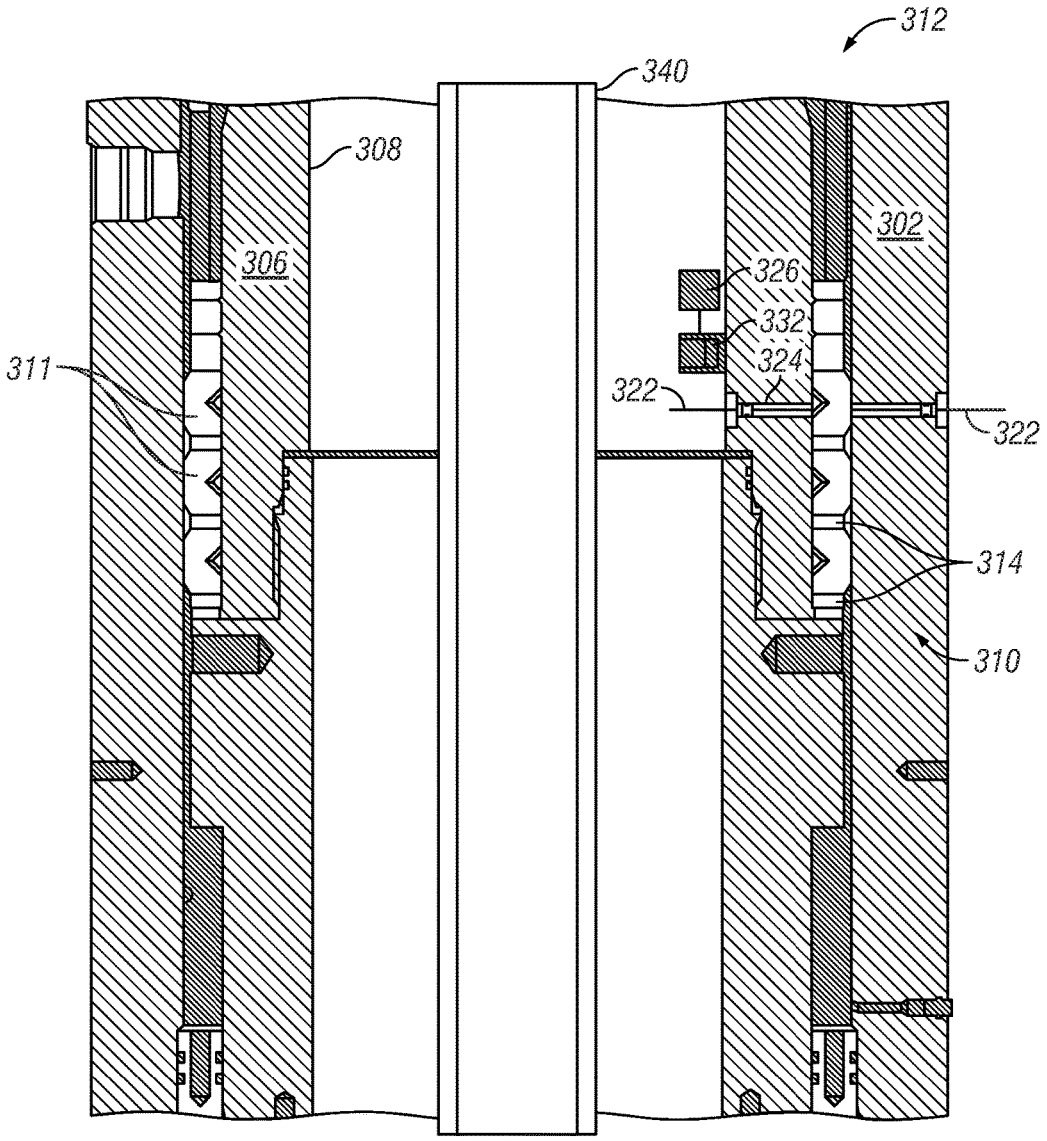
FIG. 6 depicts a cross-sectional view of an example RCD, according to one or more embodiments.

FIG. 5 is a cross-sectional view of an example RCD 312 in accordance with one or more embodiments of the present disclosure. Further, FIG. 6 is a more detailed cross-sectional view of the example RCD 312 with a drillstring 340 positioned therethrough in accordance with one or more embodiments of the present disclosure. The RCD 312 is used in a subsea or underwater environment and can be included in a riser assembly, such as to rotatably seal about the drillstring 340 to prevent the flow of high pressure annular fluids in the riser assembly. The RCD 312 is similar to the RCDs previously discussed and thus, can be used at shallow water depths (0 ft-999 ft), deep water depths (1,001 ft-6,999 ft), or ultra-deep water depths (7,000 ft and above) water depths.

In the embodiments, the RCD 312 includes a housing 302 that includes a bore 304 formed within and extending through the housing 302 about an axis extending through the housing 302. The bore 304 receives the drillstring 340 during a drilling operation, and allows the drillstring 340 to advance through the RCD 312. A rotating body 306 (e.g., cylindrical spool or tubular) is positioned within the bore 304 of the housing 302 with the rotating body 306 rotatable with respect to the housing 302 (e.g., rotatable about the axis of the housing 302). The rotating body 306 also includes a bore 308 formed within and extending through the rotating body 306.

A packer assembly 310 is included within the RCD 312 to seal between the housing 302 and the rotating body 306. The packer assembly 310 is positioned within the bore 304 of the housing 302 between the housing 302 and the rotating body 306. The packer assembly 310 seals the interior of the housing 302 and the exterior of the rotating body 306 to form a seal therebetween. The packer assembly 310 includes one or more packers 311 and one or more rings 314 positioned in between the packers 311 of the packer assembly 310. The packers 311 are formed from or include an elastomeric material, such as natural or synthetic rubber, which includes hydrogenated nitrile butadiene rubber (HNBR) or similar materials. Further, the rings 314 are formed from or include a non-metal material, such as a plastic or a polymer, which includes polytetrafluoroethylene (PTFE).

In the embodiments, a RCD acoustic transceiver 326 and a sensor package 332, among other electronic components, are electrically connected within the housing 302 of the RCD 312. More particularly, the sensor package 332 is positioned within the rotating body 306, as shown in FIG. 5. The sensor package 332 monitors performance, operational, and environmental data related to conditions related to the RCD 312. The RCD acoustic transceiver 326 is in communication with the sensor package 332 to receive the sensor data and to further communicate the data related to conditions associated with the RCD 312 to facilities or devices located at a surface location, e.g., offshore drilling system, or other underwater acoustic transceivers located externally to the RCD 312.

In operation, the sensor package 332 generates a sensor signal based upon the property measured by the signal. The RCD acoustic transceiver 326 receives and converts data from the sensor package 332 into acoustic data that is wirelessly and bilaterally transmitted to other acoustic transceivers, such as an acoustic transceiver 324. In some cases, the acoustic transceiver 324, or similar equipment, receives and compares the acoustic data with predetermined expected values to monitor the performance and operations of the RCD 312. If value is outside an expected range (e.g., too high or too low), the acoustic transceiver 324 can generate an alert that the RCD 312 is not working properly and that components of the RCD 312 may require repaired or replaced, along with data to configure or re-configure the RCD 312.

The RCD acoustic transceiver 326 transmits and receives the acoustic data through the packers 311 or rings 314 of the packer assembly 310, as opposed to other components of the RCD 312 that may be positioned adjacent or axially above or below the packer assembly 310. When the RCD 312 is used in an offshore environment, fluids or other content (e.g., drilling muds and/or seawater) are often present within and surrounding components of the RCD 312. However, during transmission, acoustic signals can be disrupted or degraded in environments having areas with high salinity or metal content. In the embodiments, the packer assembly 310 provides an area of the RCD 312 that does not include seawater, drilling mud, salt cutting, or other salty fluids that often hinder data transmission. In this regard, the packer assembly 310 is used as a medium for acoustic data transmission into or out of the RCD 312 without the use of additional electronic component and devices. Accordingly, in the embodiments, the acoustic data is transmitted through the packer assembly 310 to prevent interference or corruption with the transmission of the acoustic data.

The RCD acoustic transceiver 326 (or a portion thereof) can be positioned within the rotating body 306 or within the bore 308 of the rotating body 306. The RCD acoustic transceiver 326 can include a RCD wireless antenna 322 positioned within a recess, bore, groove, or cavity 324 formed within the rotating body 306. The RCD wireless antenna 322 and a wireless antenna of the acoustic transceiver 324 enable the transmission of the acoustic signal data between the RCD acoustic transceiver 326 and the acoustic transceiver 324. The transmission of the acoustic signal data is independent of the rotational position of the RCD wireless antenna 322 with respect to the wireless antenna of the acoustic transceiver 324.

A wave guide can be included within the RCD 312 in accordance with the present disclosure to facilitate the transmission of the acoustic data to and from the RCD 312. For example, the wave guide is positioned within the packer assembly 310 (such as between the packers 311 and/or the rings 314) such that the acoustic data may be transmitted across and received through the wave guide and the packer assembly 310. In examples, the uppermost packer 311 of FIG. 5 can be replaced by the wave guide such that the acoustic data is transmitted through the wave guide and across the packer assembly 310.

Figure 7:
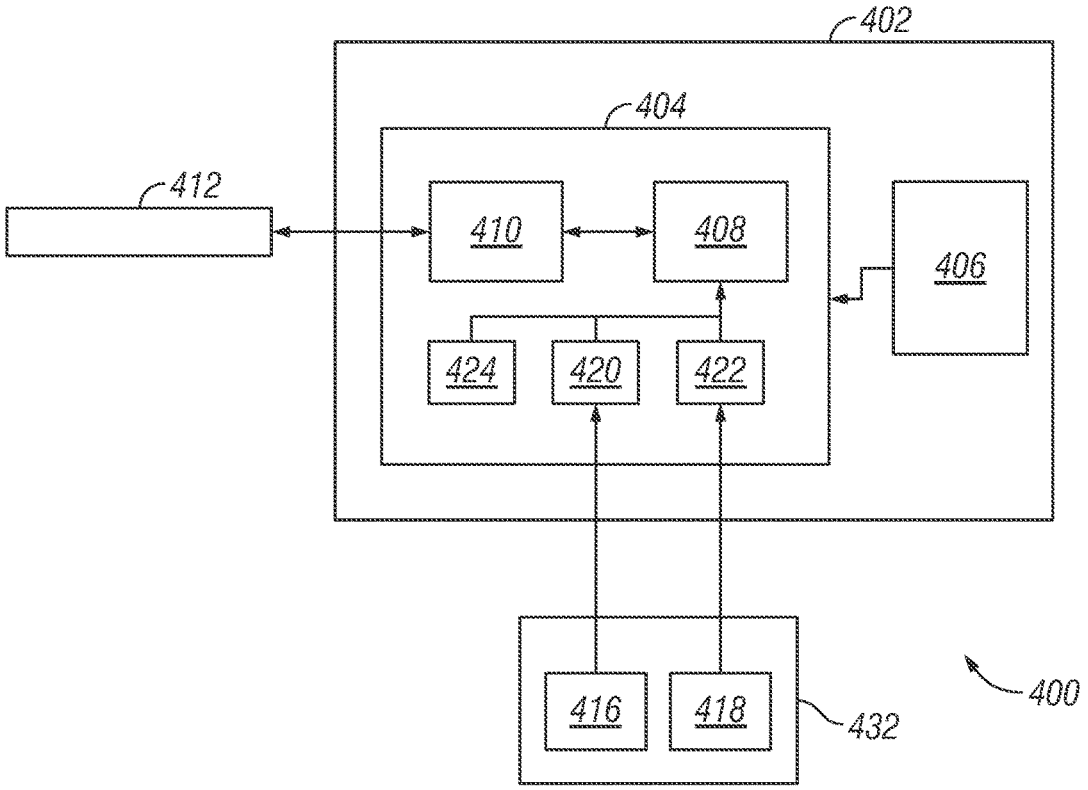
FIG. 7 depicts a schematic view of an example electronic component, according to one or more embodiments.

FIG. 7 shows a schematic view of an electronic component 400 or device in accordance with one or more embodiments, which can include or be used as a RCD acoustic transceiver. The component 400 includes an enclosure or housing 402 with a circuit board 404 and a battery 406 included within the enclosure 402. The battery 406 can be intrinsically safe and coupled to the circuit board 404 to provide power to the elements included on the circuit board 404. A controller 408 is included within the enclosure 402 and is connected to the circuit board 404.

A radio 410 may also be included within the enclosure 402 and connected to the circuit board 404 with a wireless antenna 412 in communication with the controller 408 through the radio 410. A sensor package 432 including sensors 416 and 418 (e.g., thermometer and pressure gauge) are in communication with the controller 408 through amplifiers or chips 420 and 422 connected to the circuit board 404. Further, in one or more embodiments, a sensor 424 (e.g., accelerometer) may be included within the enclosure 402 of the electronic component 400 by being connected to the circuit board 404 and in communication with the controller 408. It should be appreciated that the scope of the present disclosure is not so limited, as the present disclosure contemplates using other types of signals and forms of communications to communicate the sensor signals and data.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple"

or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A communication system for an offshore drilling system comprising:

an acoustic transceiver located at a surface location;

a rotating control device (RCD) located below sea level and comprising:

a packer assembly located inside of the RCD;

a RCD acoustic transceiver located inside the packer assembly and configured to transmit data related to the RCD through the packer assembly to the acoustic transceiver; and wherein the acoustic transceiver and the RCD acoustic transceiver are configured to wirelessly and bilaterally communicate data between the surface location and the RCD.

2. The system of claim 1, further comprising a sensor configured to be in communication with the RCD acoustic transceiver and configured to capture acoustic data related to the RCD as a sensor signal.

3. The system of claim 1, further comprising a sensor configured to be in communication with the acoustic transceiver and configured to capture acoustic data related to the RCD as a sensor signal.

4. The system of claim 1, wherein data relating to a condition of the RCD is transmitted from the RCD transceiver, through the packer assembly, and to the acoustic transceiver located at the surface location.

5. The system of claim 4, wherein the data relating to the condition of the RCD comprises real-time parameter data.

6. The system of claim 4, wherein the data relating to the condition of the RCD comprises at least one of pressure, temperature, vibration, and rotational speed data.

7. The system of claim 1, wherein the packer assembly comprises a packer and a ring.

8. The system of claim 1, wherein the RCD further comprises:

a housing comprising a bore extending through the housing;

a rotating body positioned within the bore of the housing and rotatable with respect to the housing;

wherein the packer assembly is configured to be positioned within the bore of the housing between the housing and the rotating body and configured to form a seal between the housing and the rotating body;

wherein the RCD acoustic transceiver is configured to wirelessly transmit and receive acoustic data across the packer assembly; and wherein the acoustic transceiver and the RCD acoustic transceiver are configured to wirelessly and bilaterally communicate data to and from the acoustic transceiver.

9. The system of claim 1, further comprising more than one RCD acoustic transceiver located within a housing of the RCD.

10. The system of claim 1, wherein the RCD and the RCD acoustic transceiver are positionable at a distance below sea-level that ranges from about 0 feet (0 meter) to beyond about 5,500 ft (1,700 m).

11. The system of claim 1, wherein the RCD acoustic transceiver is configured to wirelessly and bilaterally transmit the data relating to a condition of the RCD at a rate of about 140 bits per second (bps) to about 15,400 bps.

12. The system of claim 1, further comprising a repeater configured to extend a transmission distance of the data between the surface location and the RCD.

13. The system of claim 1, further comprising a wave guide positioned within the packer assembly such that a sensor signal is transmitted through the wave guide.

14. A method for communicating data related to an offshore drilling system, comprising:

wirelessly and bilaterally transmitting data related to a rotating control device (RCD) between a RCD transceiver located within a rotating body of the RCD and through a packer assembly located inside of the RCD; and wirelessly and bilaterally transmitting the data between the RCD transceiver and an acoustic transceiver located at a surface location.

15. The method of claim 14, further comprising communicating the data between the surface location and the RCD as a sensor signal.

16. The method of claim 14, further comprising capturing acoustic signal data related to the RCD via a sensor in communication with an RCD acoustic transceiver.

17. The method of claim 14, further comprising:

transmitting data related to a condition of the RCD through the packer assembly of the RCD;

transmitting data related to configuring the RCD through the packer assembly of the RCD;

receiving the data related to the condition of the RCD at the acoustic transceiver; and receiving the data related to configuring the RCD at the RCD transceiver.

18. The method of claim 14, wherein transmitting the data through the packer assembly comprises at least one of:

transmitting the data through a packer of the packer assembly;

transmitting the data through a ring of the packer assembly; and transmitting the data through a wave guide positioned within the packer assembly.

19. The method of claim 14, further comprising:

measuring temperature data within the RCD;

measuring pressure data within the RCD;

measuring vibration data within the RCD; and measuring rotation of the rotating body with respect to a housing of the RCD.

20. The method of claim 14, further comprising transmitting the data related to the RCD at rate of about 140 bits per second (bps) to about 15,400 bps.

* * * * *